US006726205B1

(12) United States Patent
Purton

(10) Patent No.: US 6,726,205 B1
(45) Date of Patent: Apr. 27, 2004

(54) INSPECTION OF PLAYING CARDS

(75) Inventor: William Westmore Purton, Heidelberg (AU)

(73) Assignee: VendingData Corporation, Las Vegas, NV (US)

( * ) Notice: Subject to any disclaimer, the term of this patent is extended or adjusted under 35 U.S.C. 154(b) by 116 days.

(21) Appl. No.: 09/638,860

(22) Filed: Aug. 15, 2000

Related U.S. Application Data

(63) Continuation-in-part of application No. 09/622,286, filed as application No. PCT/AU00/00150 on Feb. 24, 2000, now Pat. No. 6,229,894.

(51) Int. Cl.[7] ..... A63F 1/00
(52) U.S. Cl. ..... 273/148 R; 273/149 R
(58) Field of Search ..... 273/149 R; 356/390, 356/394, 398, 237

(56) References Cited

U.S. PATENT DOCUMENTS 4,951,950 A * 8/1990 Normand et al.
5,374,061 A * 12/1994 Albrecht
5,669,816 A * 9/1997 Garczynski
5,722,893 A * 3/1998 Hill et al.
5,989,122 A * 11/1999 Roblejo
6,039,650 A * 3/2000 Hill
6,217,447 B1 * 4/2001 Lofink et al.
6,250,632 B1 6/2001 Albrecht
2002/0135692 A1 * 9/2002 Fujinawa ..... 348/335
2003/0048476 A1 * 3/2003 Yamakawa ..... 358/3.1

FOREIGN PATENT DOCUMENTS

WO WO 01/56670 A1 8/2001

OTHER PUBLICATIONS

Basics of Vido and Image Processing, http://www./cs.sfu.ca/people/GradStudents/jwange/personal/htmlthesis/node9.html, Mar. 26, 1998.*

* cited by examiner

*Primary Examiner*—William M. Pierce
(74) *Attorney, Agent, or Firm*—Connolly Bove Lodge & Hutz LLP

(57) ABSTRACT

A playing card integrity checker utilises a blue light source to illuminate the playing face of each card to use template matching to identify the value and suit of each card based on stored templates from cards of the same card manufacturer. This information and the number of cards counted is matched against the cards needed for a predetermined game. The absence of required cards or the presence of superfluous cards is reported. Cards that have their faces reversed or appear marked are also reported.

13 Claims, 9 Drawing Sheets

INSPECTION OF PLAYING CARDS

RELATED APPLICATIONS

Figure 1:
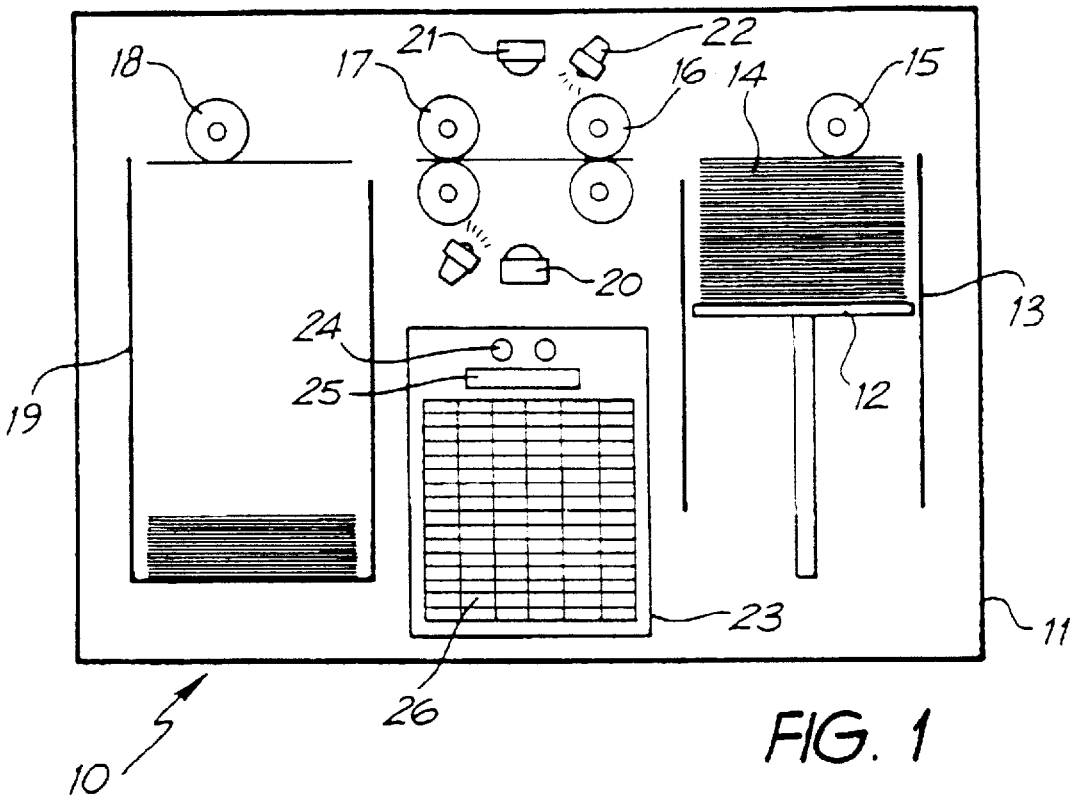

This application is a continuation-in-part of U.S. patent application Ser. No. 09/622,286, filed Aug. 15, 2000 now U.S. Pat. No. 6,229,894, which is a national phase of PCT/AU00/00150, filed Feb. 24, 2000.

FIELD OF THE INVENTION

The invention pertains to playing cards and more particularly to a device and methods for inspecting playing cards at speeds higher than achieved with manual inspection. Methods and apparatus for sorting are also provided.

BACKGROUND OF THE INVENTION

Playing cards are used in casinos worldwide. Many casinos have hundreds or thousands of decks of playing cards in use during the course of a business day. Different casino games require different decks, that is to say that not all games are played with a 52 card deck. Playing cards are currently inspected manually. A deck is inspected to insure that, the deck is complete and that no extra cards are present. This requires sorting the cards in each deck by suit and face value. Some games use multiple decks which further complicates the sorting process. Integrity checking is usually conducted before play but is desirable before during and after play. Sorting after play is also performed so that integral decks may be re-sold.

There have been shuffling and card sorting machines proposed that do identify cards that are to be dealt. U.S. Pat. Nos. 4,921,109 and 5,989,122 disclose a card sorting machine adapted for use with cards that have a bar code or similar machine readable identification. Such a requirement is impractical. U.S. Pat. No. 5,722,893 discloses a card dispenser which could use software that recognises the suit and value of each card to analyse the run of play in a casino card game. The purpose is to identify players who are using unfair strategies.

OBJECTS AND SUMMARY OF THE INVENTION

It is an object of the invention to provide an alternative to manual card inspection or sorting.

It is another object of the invention to provide a device and methods for inspecting, counting and reporting on the integrity of playing card decks.

To this end the present invention provides a playing card integrity checking machine which includes a) a hopper for one or more decks of cards b) a card inspection station located adjacent said hopper c) a card transport mechanism for removing individual cards from said hopper and transporting the cards individually past the inspection station to an exit or to an accumulator bin d) said card inspection station including a light source to illuminate at least one portion of the face of said card and a light receiver for receiving light reflected from the said one portion of said card e) a programmable device programmed to analyse the received image to determine the suit and value of individual cards f) said programmable device also being programmed to determine i) the number of cards in each suit ii) the number of suits iii) the presence of duplicate or other superfluous cards in the deck iv) the presence of boxed cards v) optionally, the absence of any cards that should be present g) said programmable device being programmed to report i) if there are duplicate or additional cards in the deck ii) if there are any boxed cards in the deck iii) whether all cards that should be present are present, or iv) if there are cards absent from the deck h) display or printing means being connectable to said programmable device for displaying or printing said report.

By this apparatus the present invention provides a simple dedicated integrity checking machine that does not rely on barcodes or other machine readable identification. The card suit and value is detected by analysis of a portion of the card face. This information is then used to determine if the deck lacks integrity. Such a device has not previously been available.

Throughout this specification suit is meant to include the family or group of cards in a deck whether the deck be a tarot set, chinese or a conventional casino style set of 4 suits [clubs, spades, hearts or diamonds] of thirteen cards each. Cards in such games are usually individually identified by suit and value. Value means the status of the card within a suit.

The term boxed is a card that is reversed compared to the rest of the deck that is it is face up rather than face down when being dealt. A boxed card within a deck means that the deck has lost its integrity for most games played at casinos. This invention is partly predicated on the discovery that analysis of a reflected image from the face of a playing card is enhanced if a particular frequency range of illuminating light is used. This is preferably in the blue range of the spectrum.

To this end the present invention in a second aspect provides a playing card integrity checking machine which includes a) a hopper for one or more decks of cards b) a card inspection station located adjacent said hopper c) a card transport mechanism for removing individual cards from said hopper and transporting the cards individually past the inspection station to an exit or to an accumulator bin d) said card inspection station including a blue light source to illuminate at least one portion of the face of said card and a light receiver for receiving light reflected from the said one portion of said card e) a programmable device programmed to analyse the received image to determine the identity of individual cards f) said programmable device also being programmed to determine the number of cards in the deck g) said programmable device being programmed to report one or more of the following i) the number of cards in the deck ii) whether all cards that should be present are present, or iii) if there are cards absent from the deck h) display or printing means being connectable to said programmable device for displaying or printing said report.

Illumination of the card face is preferably provided by one or more blue LEDS. The image reflected is captured by a digital camera relying on grey scale for image analysis. Image analysis is done by the software and without recourse to the colour of the suit, by examining parameters of the camera image such as image "centre of gravity", perimeter length, number and type of edge and other characteristics of the suit and value as they are displayed on the cards. The data output can be used to determine the identity of a card or to "train" verification or recognition software for future use. In the alternative, full colour imaging (digital or analogue) may be employed.

BRIEF DESCRIPTION OF THE DRAWING FIGURES

Figure 2:
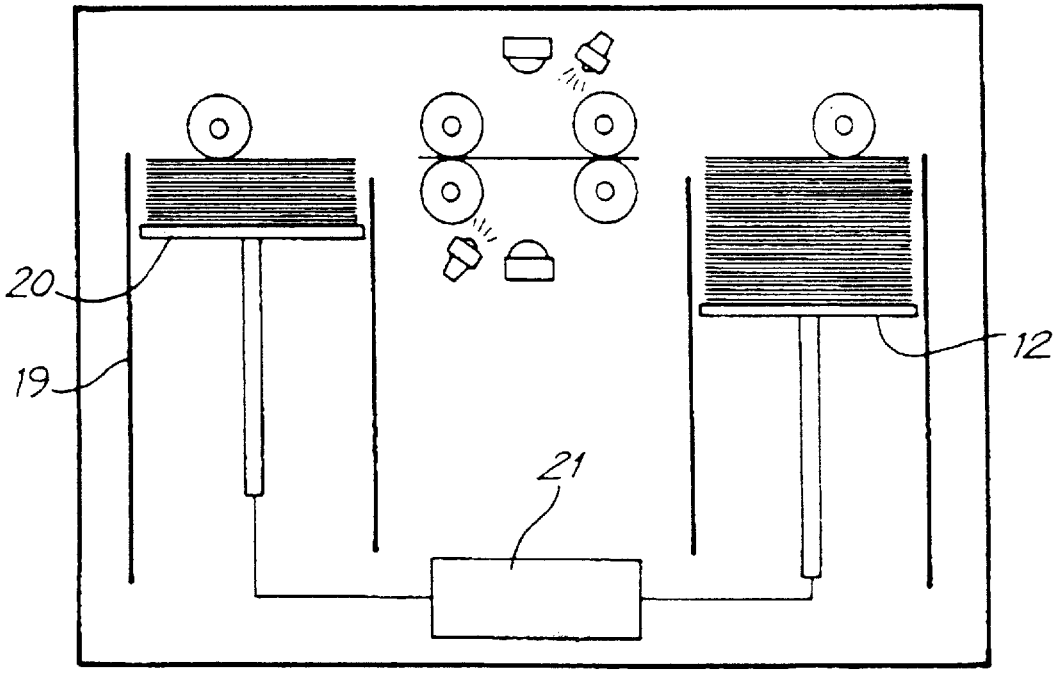
Figure 3:
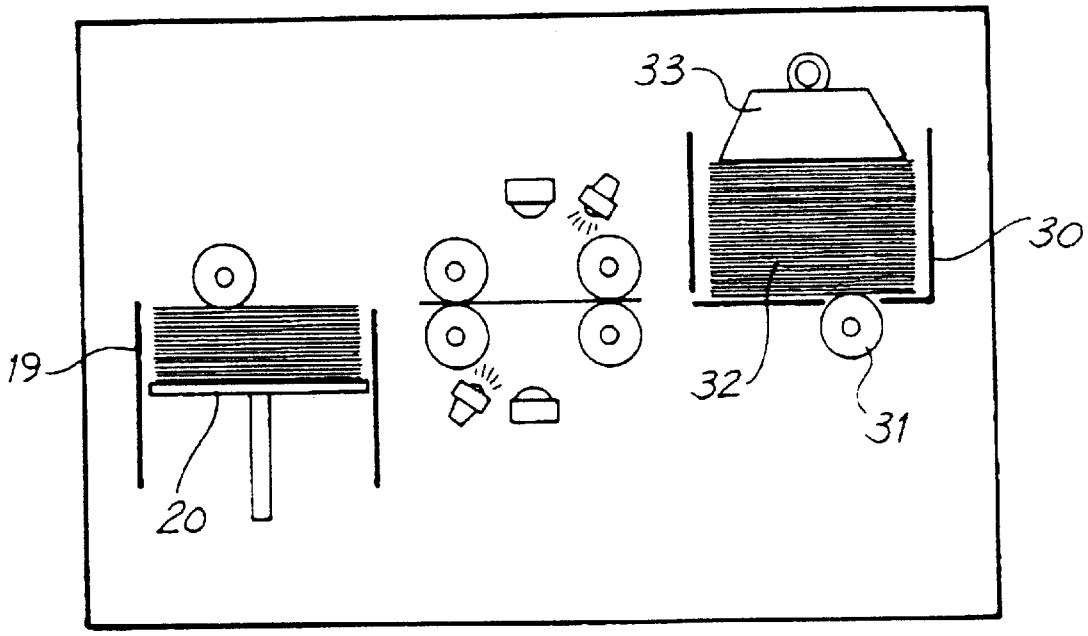
Figure 4:
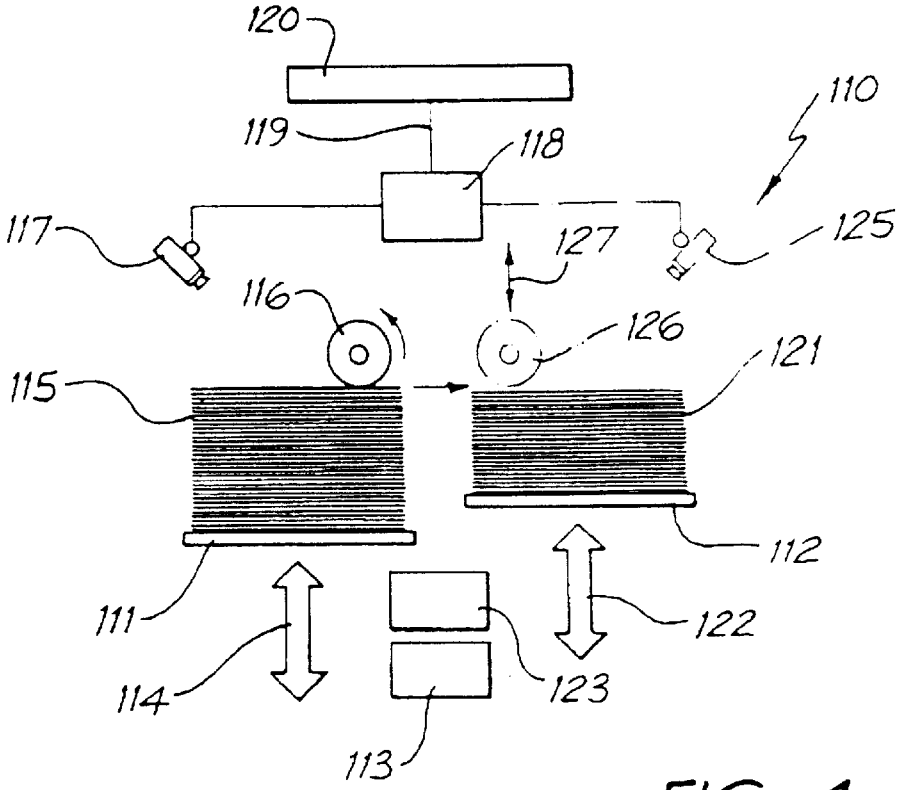
Figure 5:
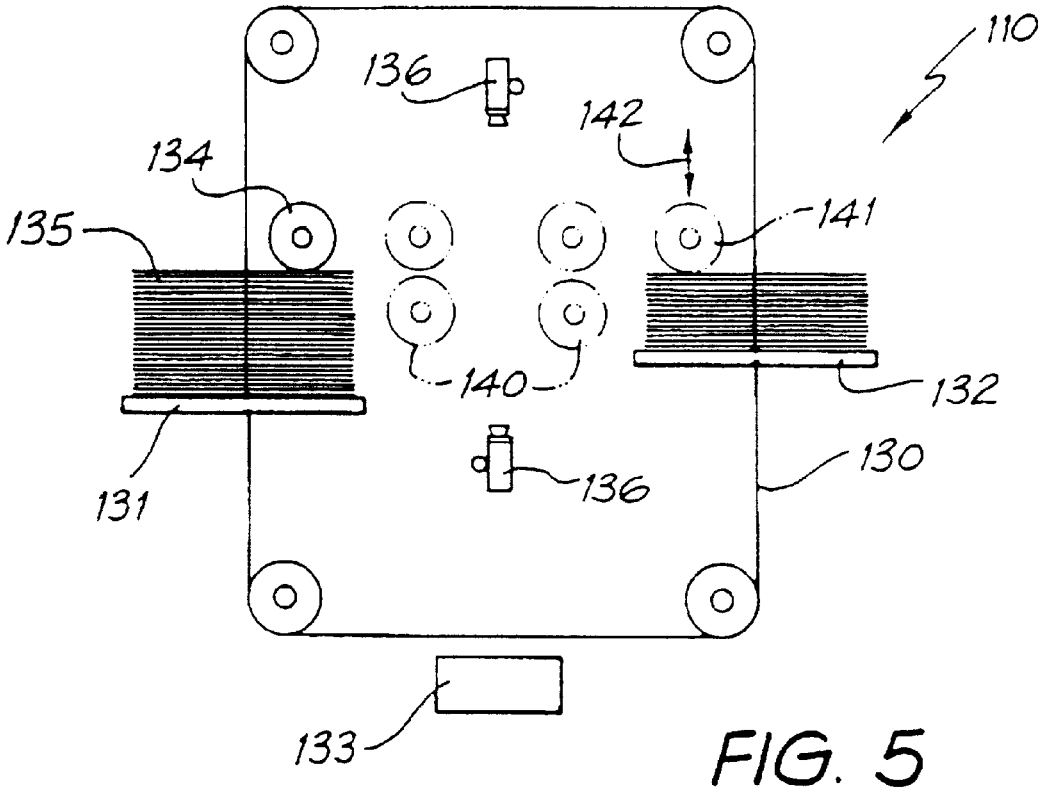
Figure 6:
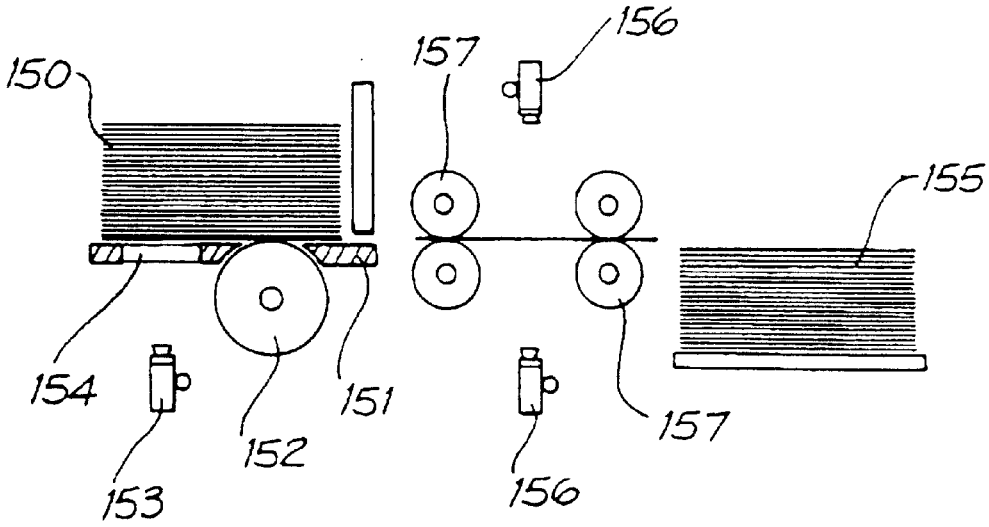
Figure 8:
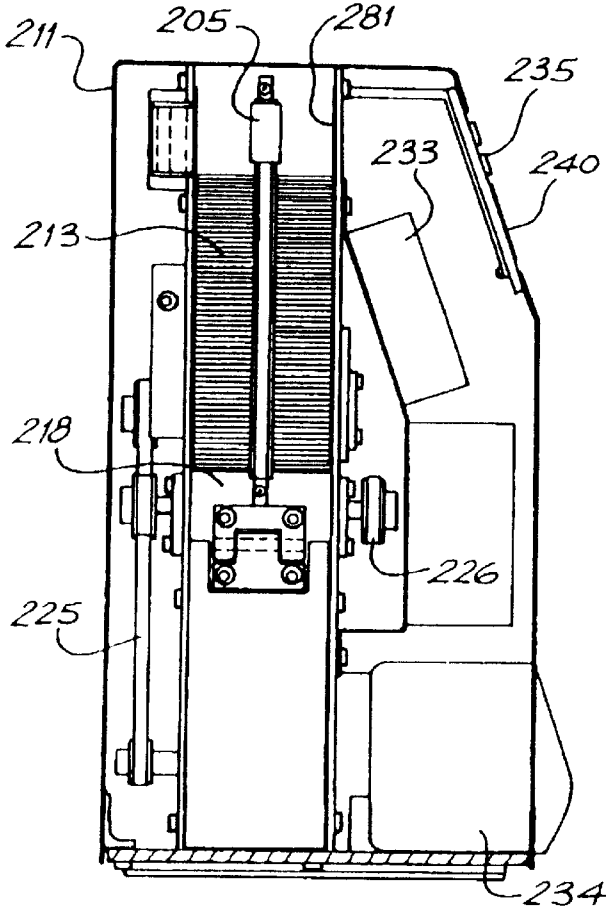
Figure 7:
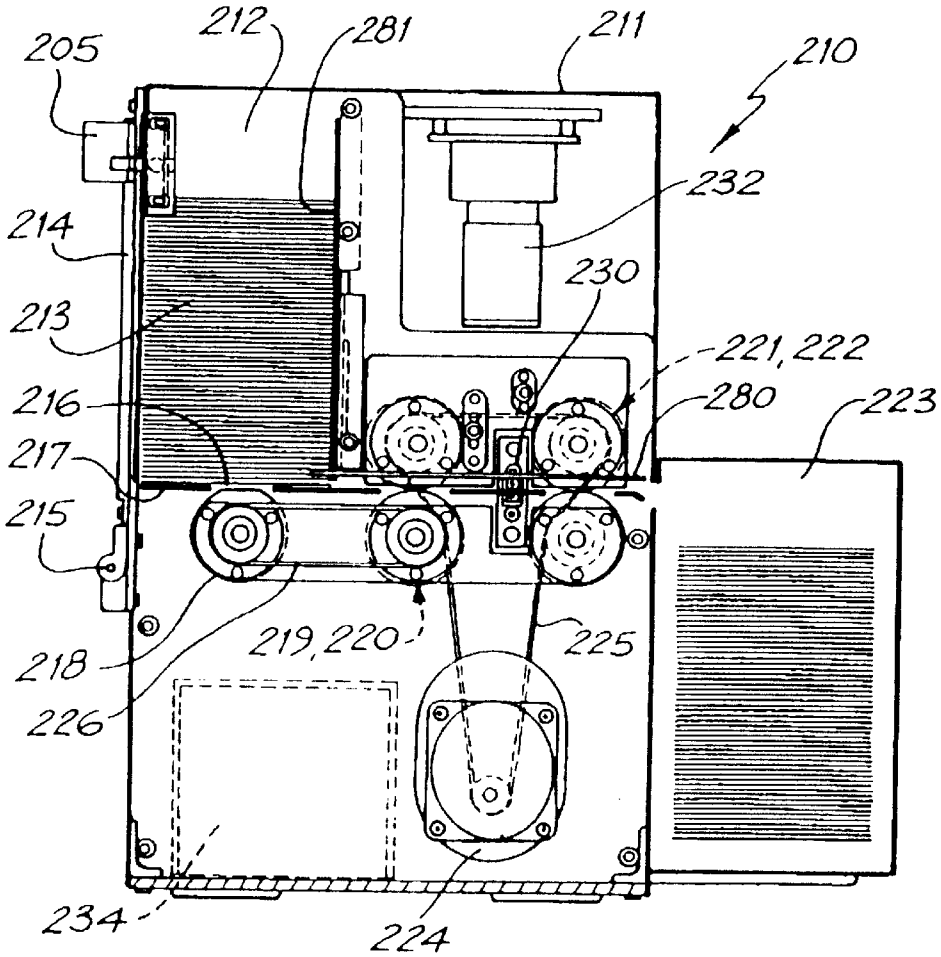
Figure 10:
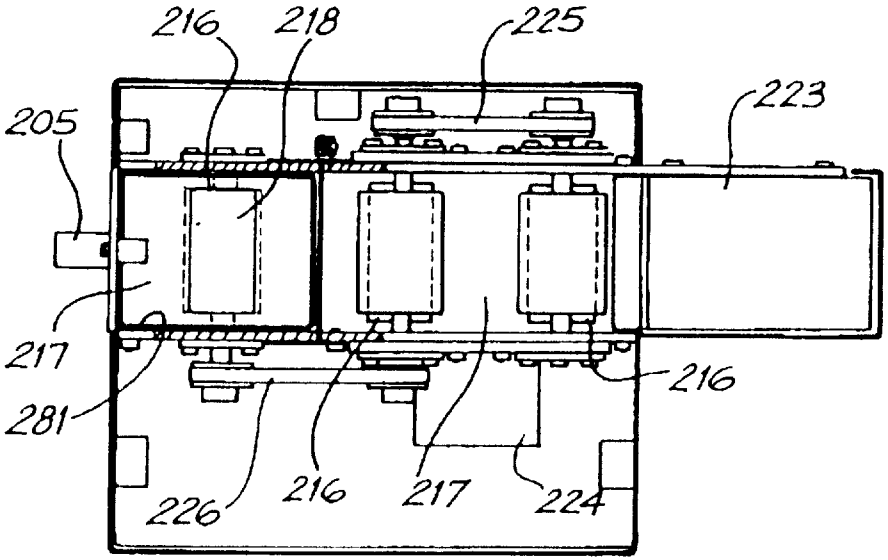
Figure 11:
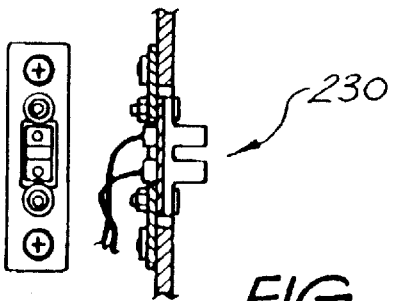
Figure 9:
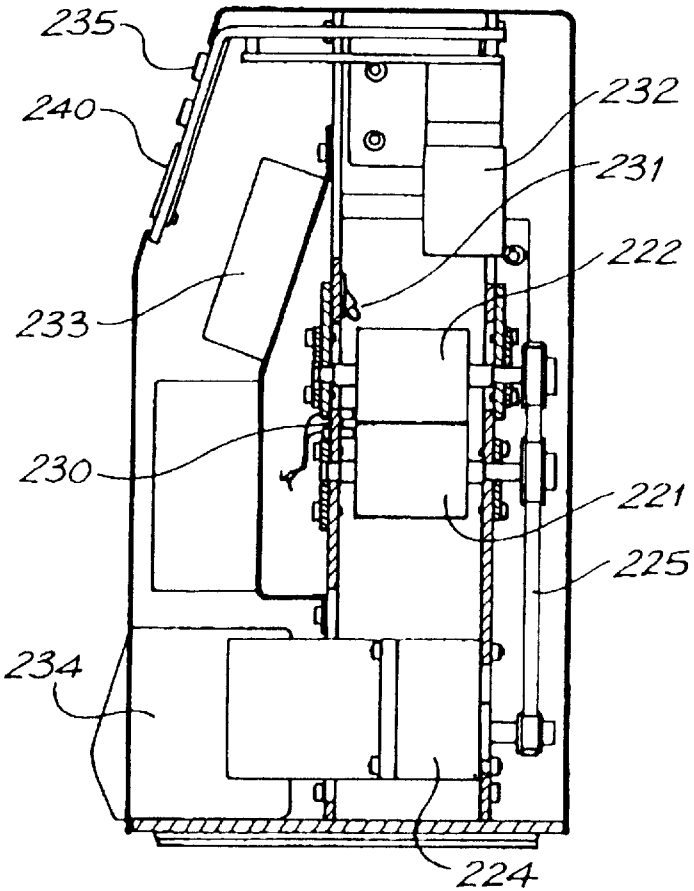
Figure 12:
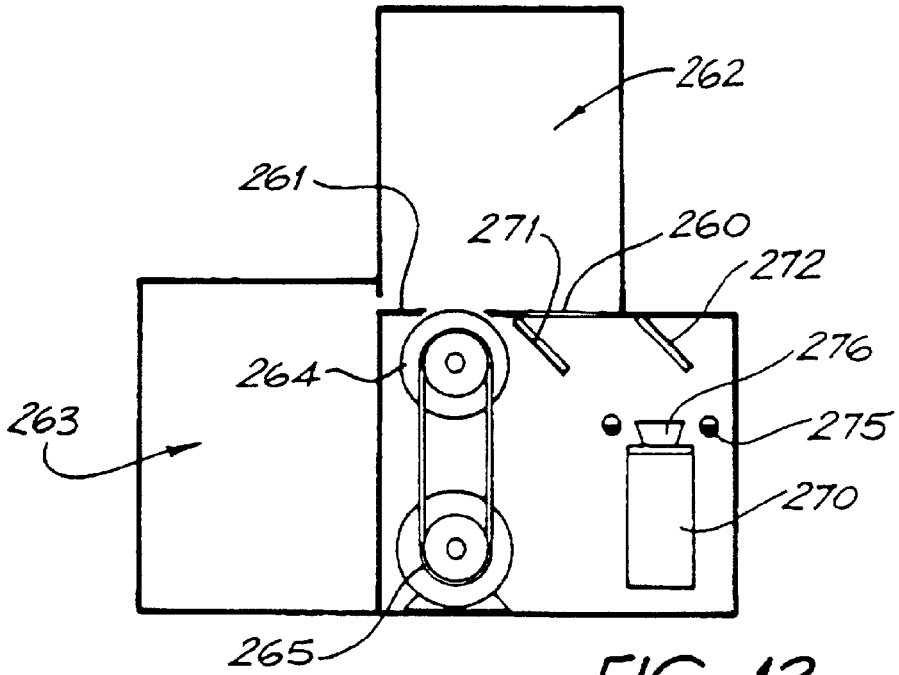
Figure 13:
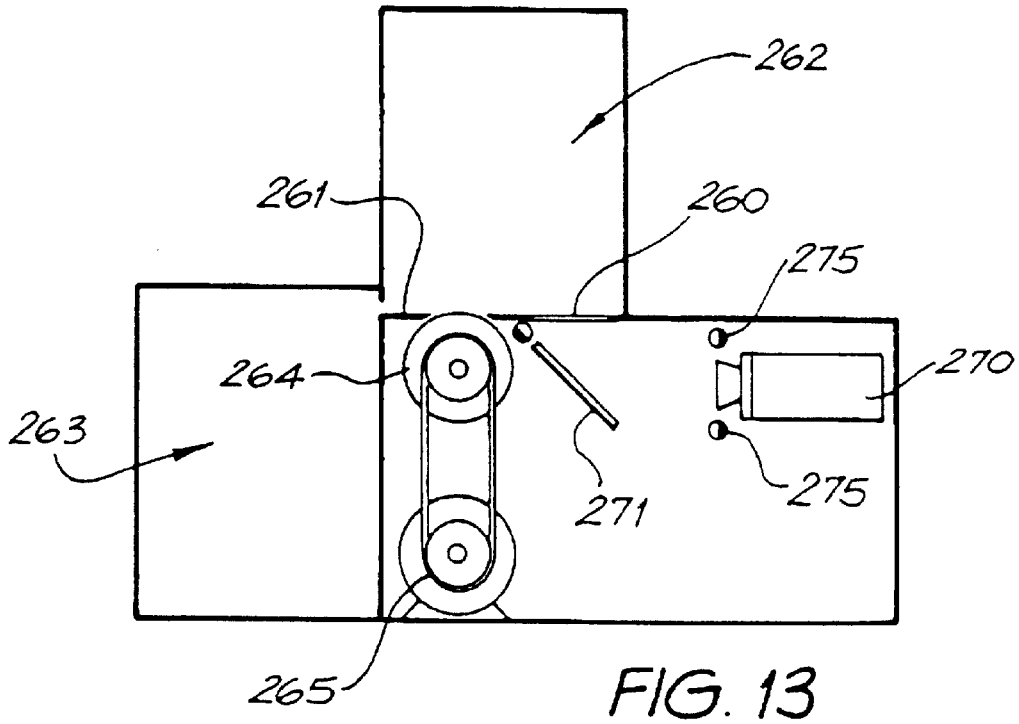
Figure 14:
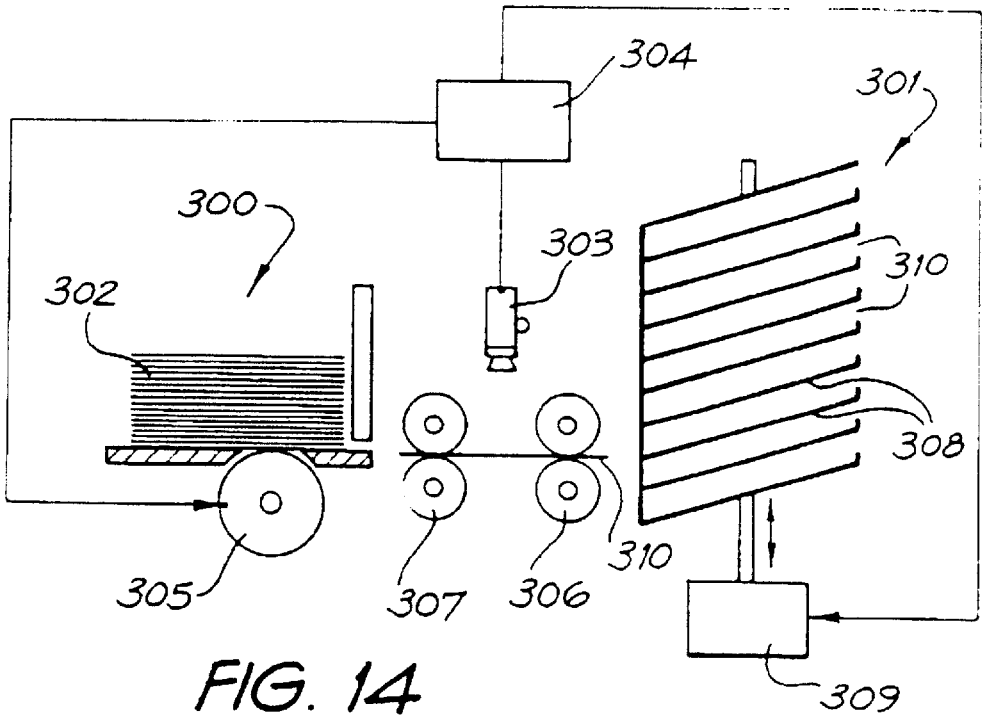
Figure 15:
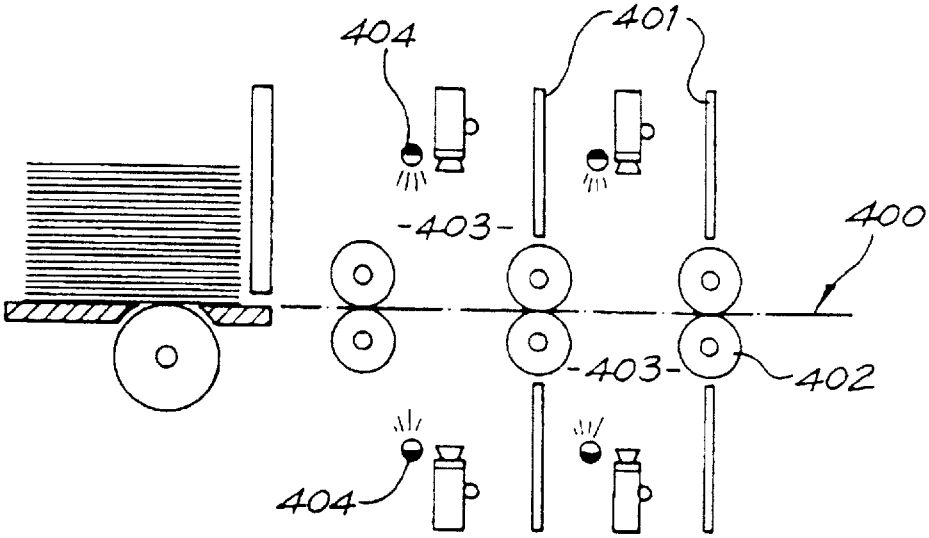
Figure 16:
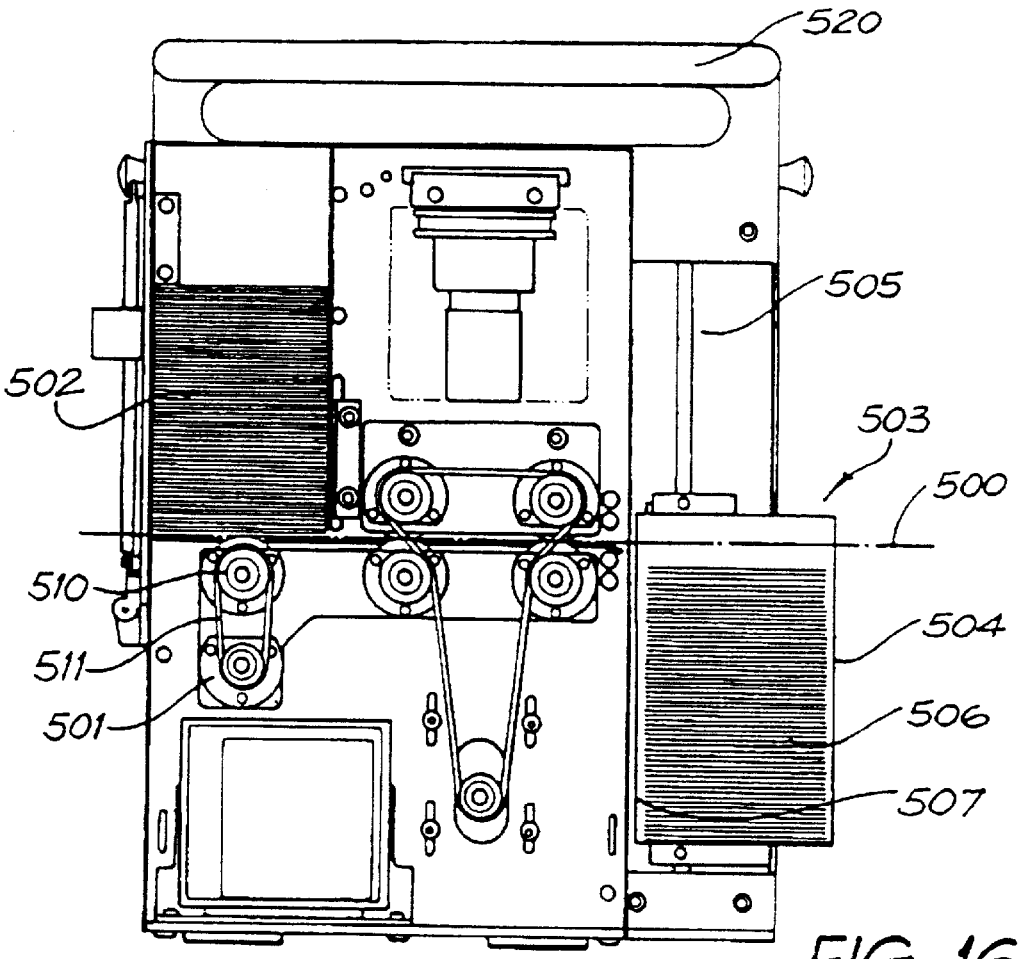
Figure 17:
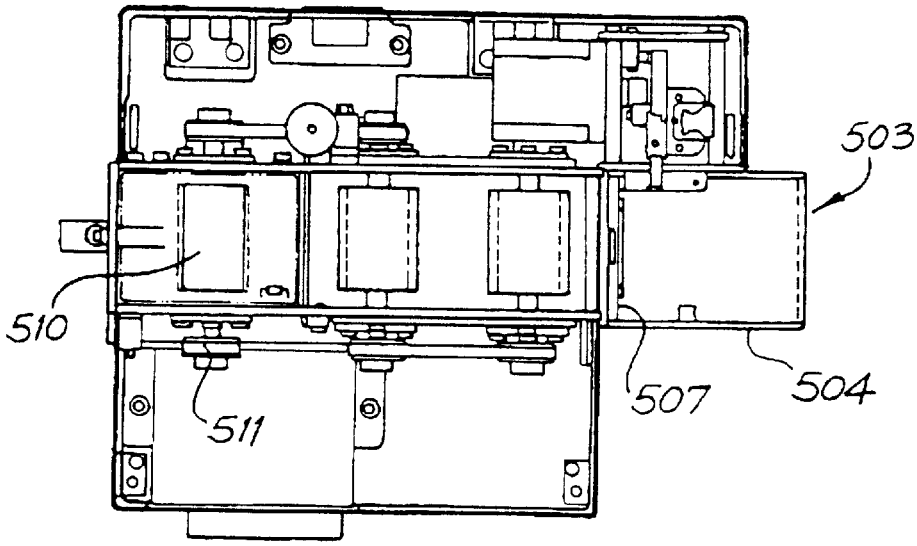
Figure 19:
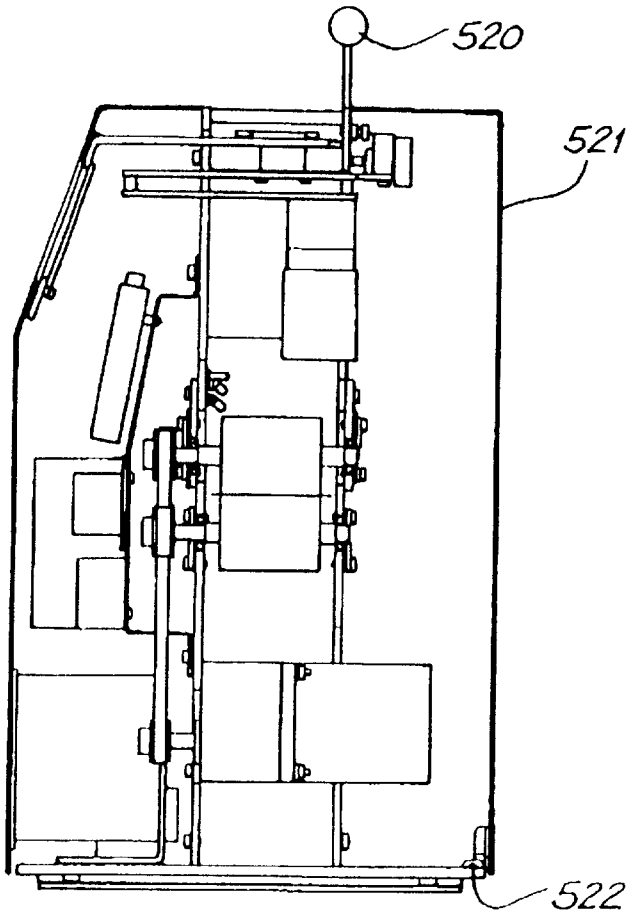
Figure 18:
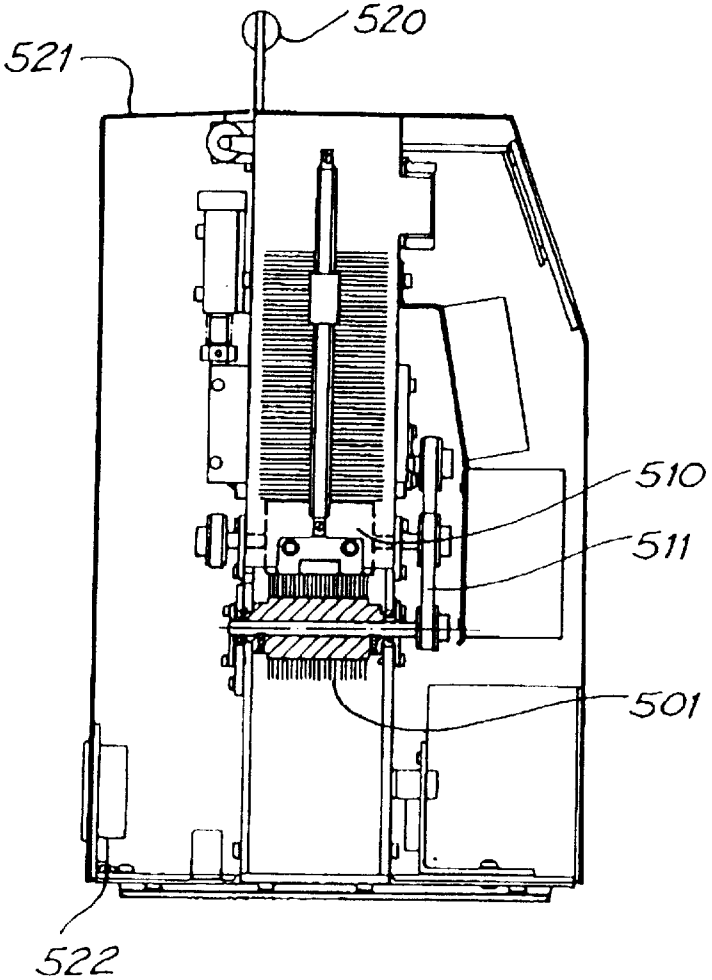

FIG. 1 is a schematic diagram illustrating an example of a card inspection device according to the teachings of the present invention, FIG. 2 is a schematic elevation of an embodiment of a card inspection device according to the teachings of the present invention, FIG. 3 is a third embodiment of a card inspection device, FIGS. 4 and 5 are schematic illustrations of alternate embodiments of a card inspection device according to the teachings of the invention, FIG. 6 is a schematic side elevation of a transport mechanism including camera placements for a card inspection device, FIG. 7 is a cross section of a card inspection device, FIG. 8 is a cross sectional side elevation of a card inspection device, FIG. 9 is another cross sectional side elevation of a card inspection device, FIG. 10 is a cross sectional top plan view of a card inspection device, FIG. 11 illustrates front and cross sectional side views of a card sensor, FIGS. 12 and 13 are schematic cross sections of a card inspection device featuring a single drive roller, FIG. 14 is a schematic illustration of a card inspection device with collation features according to the teachings of the present invention, FIG. 15 is a schematic side elevation of a device incorporating an arrangement of tool sensors and baffles, FIG. 16 is a cross sectional elevation of a further embodiment including drive roller cleansing brush and removable accumulation container, FIG. 17 is a top view of the device depicted in FIG. 16, FIG. 18 is a left side elevation in cross section depicting the device shown in FIG. 16, FIG. 19 is a right side elevation which has been cross sectioned to illustrate the interior of the device depicted in FIG. 16.

BEST MODE AND OTHER EMBODIMENTS OF THE INVENTION

As shown in FIG. 1, a card inspection device 10 of the present invention comprises a secure cabinet 11 which affords the user easy access to a card loading area 13 and a card accumulation area 19. The card loading area incorporates moving platform or elevator 12. Cards 14 are placed on the loading platform or area 12 which is capable of lifting the one or more decks into engagement with a feed roller 15. The feed roller 15 feeds individual cards between the first of a pair of transport rollers 16. Cards are passed between the first pair of transport rollers 16 to a second pair of transport rollers 17. An optional take-up roller 18 assists the cards into the accumulation area 19.

Below the gap between the first and second transport rollers there is located an optical scanning device. The scanning device 20 reads the card passing through the roller pairs and transmits the scan information to a computer or other signal processing device which identifies the value and suit of the card and compiles a tally of all cards read. The optical scanner may also be located above the gap 21 if the cards are face on the platform 12. In the alternative, optical scanners can be positioned both above and below the gap so that both sides of a card may be read or so that inverted cards may be detected and identified. Preferably a low temperature source of light 22 is located so as to illuminate the area of the card that is being scanned.

The computer or signal processor compiles the scan data and reports and records the result of the scans of all of the cards in the one or more decks. Preferably, the report is displayed on a graphic indicator 23. The report data or any portion of it may also be provided as the output of a RS232 port or other data port. The indicator 23 may be mounted directly on the cabinet 11. The indicator may include, for example, a red warning light 24 to show when an irregularity has been detected by the computer or signal processor. An adjacent green light would be indicative of a successful scan. In addition another display 25 could be used to reveal the exact card count. Another display 26 could be used to display exactly how many of each card were detected. For example a display matrix 26 could show all possible card values (ie. A, K, Q . . . 4,3,2 . . . Joker . . . blank) in a first column and all possible suits in a first row. By reading the numerical value in the intersection of a row and a column, one can determine the quantity of each card in the deck or decks scanned. For example in an eight deck scan, one would expect that the display 26 would show in the intersection of the K(ing) row and the Spade column, the value 8.

FIG. 2 illustrates, schematically, that the card accumulation area 19 may also be supplied with a moving accumulation platform 20. A means 21 of synchronising the two platforms 19 and 12 may also be provided. The means for synchronising 21 may be mechanical (pulleys, cables, toothed belts etc.) or electromechanical using servo motors or sensors etc. In this way the rising of the loading platform 12 may be synchronized with the failing of the accumulation platform 20.

As shown in FIG. 3, the cards 32 to be scanned may also be loaded from above, rather than from below. In this illustration, the cards are loaded from above into a bounded loading area 30. Cards are fed into the transport rollers by a feed roller 31 located below the cards 32. A weight 33 may be placed on the cards 32 to facilitate contact with the feed roller 31.

As shown in FIG. 4, a further embodiment of a card inspection device 1 comprises two card platforms 111, 112. Cards are placed face up, for example, on the first platform 111. An electric motor 113, for example a DC stepping motor is mechanically coupled to the first platform 111. When the appropriate commands are provided to the electric motor 113, the platform 111 goes up (as suggested by the arrow 114) so that a stack of playing cards 115 is urged into contact with a drive roller 116. In this example the face up cards in the feed stack 115 are individually imaged by a downward looking digital camera 117. A mirror may be employed so that the camera may read the face up cards from other orientations. The imaging information is provided to a microprocessor or digital signal processor 118. The output 119 of the microprocessor 118 is used to drive any number of devices including for example a visual display, alarm devices or a printer (the various output devices being signated together as item 120).

The drive roller 116 ejects the cards from the first stack 115 into—a second or output stack 121 so that the output stack forms in an orderly fashion, the second platform 112 descends 122 at the same rate s or at least in synchrony with the first stack.

The motion of the second platform 112 and second stack 121 may be governed by the same electric motor 113 that drives the first platform 111. In the alternative, the motion of the second platform 112 may be determined by an optional second electric motor 123 which is synchronised with the first motor 113 so that the stacks move at the same rate but in opposite directions.

In another embodiment of the invention, the downward looking digital camera 125 (or mirror arrangement) is placed above the second stack, looking down at it to image cards only after they have been loaded into the second stack 121. In any of the embodiments discussed here, a digital camera may image by looking at a mirror aimed at the target area of a card rather than at the target area directly. The use of a mirror folds the image oath and can make it more compact.

So that the device may be loaded from either platform, 111 or 112 an additional and optional second drive roller 126 may be provided above the second platform 112. When cards are being fed by the first drive roller 116 from the first stack 115, the second drive roller 126 is raised 127 so that it does not interfere with the passage of playing cards from the first stack to the second. When the second drive roller 126 is used to feed cards onto the first platform 111, the first drive roller 116 must similarly be elevated to avoid interfering with the passage of cards onto the first platform 111.

As shown in FIG. 5, a single continuous belt 130 may be used to drive both card platforms 131, 132 in synchrony and with a single electric motor 133 (for example a DC stepping motor). Where the device 110 is only intended to feed cards from the first platform 131, to the second platform 132 only a single drive roller 134 is required. In this case, the first platform 131 is elevated by the continuous belt 130 so that the first stack 135 is brought into contact with the drive roller 134. The drive roller 134 transports cards to the second platform 132. The digital camera 136 may be located between the two platforms 131, 132 (either above or below) or it may be located directly above either platform as explained with reference to FIG. 4. Optional pairs of pinch rollers 140 may be provided between the two platforms 131, 132 to assist in the transport of cards from one platform to the other. Together, the drive roller 134 and the pinch rollers 140 define a transport path for the cards. So that the device 110 of FIG. 5 may be loaded from either platform 131, 132 a second and optional drive roller 141 may be provided above the second stack 132. As mentioned with reference to FIG. 4, the second drive roller 141 must be elevated 142 when cards are being fed from the first platform 131. When feeding from the second platform 132, the direction of motion of the pinch rollers 140 must be reversed. Similarly, the direction of the belt 130 must also be reversed so that the first platform 131 is lowered as the second platform 132 is raised.

As shown in FIG. 6, a card stack 150 may be supported by a platform 151 through which a drive roller 152 extends. This allows cards to be fed from the bottom of the stack 150. In this embodiment, the cards are placed face down. So that each card may be read by an upward looking digital camera 153, the platform 151 is provided with a window or opening 154. In the alternative, the cards may be read between stacks 150, 155, by a digital camera 156 mounted above (with the cards face up) or below the pinch rollers (with the cards face down) 157 which facilitate card transport between the two stacks 150, 155.

As shown in FIGS. 7–10, another embodiment of a card auditing machine 210 comprises a case 211. Within the case, an input or loading bin 212 is adapted to receive one or more decks of cards 213. The cards are loaded face up. A door 214 to the loading bin is hinged 215 along a lower edge. A free sliding weight 205 extends into the loading bin and when released, impinges on the cards 213 and urges them downward. A free weight may also be used. The base of the loading bin is defined by a platen 217 having a rectangular opening 216. The cards 213 rest on the platen 217. The first roller 218 is formed as a cam, that is, a cylinder from which a flat spot along its entire length has been removed, for example, by abrasion. The roller rotates at a fixed speed and when it is in contact with a card, imparts a linear motion to the card. The flat spot on the roller does not contact the cards and therefore defines a gap between successive cards which are being urged by the roller 218 into the card path.

A card from the bottom of the stack (or the last one) is propelled by the first roller toward and into engagement with a first pair of rollers. The first pair of rollers 219, 220 pinch together lightly (but need not contact) and rotate in synchrony. The first pair 219, 220 receives the card (preferably still in contact with the first roller) and advances the card toward and into engagement with the second pair of rollers 221, 222. Because the distance between the pairs of rollers Is equal to or less than the length of the card in the direction of the path, positive control of the card is maintained until the card is ejected from the second roller pair 221, 222 into the output bin 223.

In alternate embodiments, the platen 217 optionally extends along the card path past the loading bin 212 so as to support the card, at least as far as the second roller pair 221, 222 (or as required). Openings 216 in the platen 217 allow both rollers in each pair to be positioned in the card path. Additional guide rails 280 adjacent the card path may be used to assist the transport.

As seen in FIG. 7, a single motor 224 drives all five rollers 218–222. A single belt 225 drives the two pairs of rollers 219–222. A second belt 226 goes around the sheaves associated with one roller 219 of the first pair and the first roller 218. A card presence sensor 230 (see FIG. 11) is located between the roller pairs 219–222. The sensor uses, for example, optical means to detect the presence and position of a card and may act as a trigger to the camera control software so that an image will be captured at the appropriate point in time. The sensor may also be used to detect machine malfunctions. By detecting that the frequency of cards passing it varies from the expected rate, the sensor output may be used to report malfunction or failure or to cause the machine's operation to be ceased.

As there is no appreciable light within the case 211, an LED illuminator 231 is also located between the roller pairs. The illuminator comprises a single or multiple LEDS. The LED illuminator provides an output in the blue range which is optimised to maximize the contrast in the monochrome image made by the red suits. In this (monochrome) example, six individual blue LEDs are assembled into a bank to provide adequate and even illumination. Thus, in this monochrome example red and black are practically indistinguishable, but the enhanced performance in the red range is traded for colour (red-black) detection, which is of little use. The camera 232 reads the face of the cards and using on board image processing, provides a data output which includes the suit and value portion of the face of the card. A keypad 235 on the front of the machine is used to input data about the identity of the user, the location or table number, the game the cards are used for, the card manufacturer, the number of packs to be checked and configuration information such as time and date etc. The user may be lead through the data input routine by prompts provided on a display screen 240, in this example, located near the keypad. The keypad input and camera output are used to generate a file which can be printed by the printer 234 or displayed on the front panel display 240. The keypad may also be used for secure access and other control functions related to the use of the device.

Card Scanning and Recognition

The camera snaps images at the rate of 50 images a second. Card presence is detected by searching along a vertical search line in the image for pixels above a preset grey value threshold. If a card is detected the image is retained for further processing.

A grey value threshold is applied to the region of interest to classify pixels into black or white. Because the cards are viewed under blue light the red symbols appear black.

Black objects are identified an the properties (area, centre of gravity, position of top/bottom/left-most/right-most edges) of each object is calculated. If a large number of small objects is found ie. A pattern the card is deemed to be a back, that is it is reversed.

The most likely candidates for suit and type of card are found using the following constraints:

Suit: left most object above a certain size not touching the border region of interest.

Type: biggest object not touching the border region of interest.

These constraints are designed to eliminate the edge of the card or parts of picture card borders from being mistaken for suit or type symbols.

If objects fulfilling these requirements are not found the card is deemed "unrecognised."

Suit and type are then determined by matching the suit and type objects against previously captured templates. The template objects are aligned with the objects to be identified using the center of gravity of each object and the match is calculated by adding up the number of pixels which are different. This technique is known as template matching. If no close match is found the card is deemed "unrecognized". The set of templates used has been selected by the operator from a number of sets of precaptured templates corresponding to the cards of different card manufactures. These sets can be created by passing an example of each card type through the machine and storing the template images in the non volatile memory of the camera. This enables the machine to be calibrated for new sets of cards.

The machine continues to run identifying cards until the in-tray sensor indicates that no cards are left in the hopper and no cards have been sensed for two seconds. If a card is detected continuously for more than 1.5 times the normal duration under the camera a card jam is flagged and the machine stops.

Some playing cards carry a significant static charge and are difficult to separate. Accordingly, the device may incorporate a means for removing or dissipating the static charge. One method of dissipating the static charge is to line the input bin with a material such as polyethylene impregnated with carbon black 281 (see FIGS. 7 and 10). Conductive brushes which contact both surfaces of the card may be used. Such brushes should be placed, for example, after each or any exit side of a pair of transport roller or the exit of the device.

In keeping with the teachings provided above, simplified mechanical transport may be achieved, as shown in FIGS. 12 and 13, by providing a window or transparent region 260 in the bottom surface or floor 261 of the input bin 262. This allows cards (now face down) to be read from within the bin 262. Cards are removed to an output or collection bin 263 by a roller 264. The roller may be driven directly or with a motor and belt system 265. If the camera 270 will fit directly below the window 260 it may be located there without the need for mirrors or prisms. If more room is required, the camera or imager 270 may be offset with the use of mirrors or prisms 271, 272. Vertical and horizontal camera placements are depicted in FIGS. 12 and 13. Lighting for such arrangements may be provided by locating the LED or other illumination source 275 so that it shines in the mirror 271 but is not directly in the optical path of the camera. As shown in FIG. 12, upward shinning LEDs may be located near the lens 276 of the camera without blocking the view of the camera. As shown in FIG. 13, additional and direct illumination my be provided by locating LEDs near the window 260.

As shown in FIG. 14, a card inspection device 300 may be equipped with a collator 301 rather than a single collection stack. One purpose of a collator 301 is to allow the unsorted cards in the input stack 302 to be reassembled into useable and potential vendible decks. In this example, the output of the digital camera 303 is supplied to a microprocessor 304. The microprocessor 304 performs the functions which have been described above and in addition co-ordinates the timing of the main drive wheel 305 and intermediary drive or transport rollers 306, 307 with the movements of the collator 301. The collator 301 features a plurality of output trays 308 each of which are capable of receiving individual cards and each of which can accommodate a full deck. The trays 308 move, for example, up and down owing to the operation of a transport mechanism 309 which receives instructions from the microprocessor 304. Individual cards 310 are first read by the digital camera 303 and microprocessor 304 before being introduced into a tray 308. The microprocessor 304 tallies the value and suit of each card in a tray 308. When it is determined that the insertion of a card 310 would represent a duplicate within a given tray 308, the microprocessor 304 instructs the transport mechanism 309 to present a new tray 308 to the exiting card 310.

In this way, no tray 308 can contain duplicate cards. The initial input from the machine operator instructs the microprocessor 304 as to how many decks will be input into the device. This data is used to then instruct the collator 301 as to how many trays 308 to present to the cards exiting the device. The transport mechanism 309 may consist of a belt drive or a direct drive mechanism featuring a DC stepping motor and controller which is responsive to the command signals sent by the microprocessor 304 or peripheral device under the control of the microprocessor 304. Each tray 308 features an exit opening 310 through which cards may be removed. Ideally, the collation process will produce an intact and integral deck in each operational tray 308. It will be appreciated that a collator 301 may be used as an accessory to or as a replacement for the output stack in any one of the embodiments that have been disclosed.

As shown in FIG. 15, some embodiments of the invention utilise other sensors in addition to a digital camera. In addition to the digital imaging camera and its light source which have been discussed above, a device according to the teachings of the present invention may also incorporate a line scanner, a photodiode or a plurality of different sensors, each of which responds to a different type of light source. Casino players are known to utilise pinholes, score marks, scratches, marking inks and invisible chemicals which may make microscopic surface changes on the cards for the purpose of cheating and defrauding casinos. As mentioned above, the detection of card suit and value may be accomplished with a blue LED.

The detection of different forms of tampering requires the utilisation of white light, polarised light, UV, IR (infra-red) and other coloured light. In addition, the card's fluorescence and absorption properties on both surfaces may need to be sensed. Inspection of the rear surface of the cards is most likely to reveal tampering or fraudulent changes in the pattern utilised by players to identify specific cards. Pattern analysis of the back of the cards may be used to detect anomalies in the decorative pattern of the card back.

It has been found that the orientation of a light source may need to be changed during the examination of a card. Different lighting conditions and lighting orientations may therefore be required to detect deliberate or incidental handling damage which may act as a cue for card counters and cheats. In order to enable the device to contend with many different forms of detection and light sources, the card transport path must be subdivided.

FIG. 15 illustrates how a card transport path 400 may be subdivided by locating baffles 401 above or below the roller pairs 402 in order to create distinct zones 403. Each zone 403 may have a particular form of detector, polarimeter, diode or line scanner as well as a particular light source or lighting method. By locating sensors both above and below the transport path, both sides of the card may be examined simultaneously. This provides the opportunity to detect suit and value of an inverted card as well as increasing the sophistication with which tampering may be detected. Polarised light may be used to detect certain forms of tampering. In such a case, the polarity of the light source may be rotated during the detection process. Similarly, an unpolarised source may be moved during the detection process to create a moving shadow.

One or more light sources 404 may be movable or set to illuminate off axis so that certain forms of scratches and pinholes may be more easily detected by their shadow or reflectance. It is contemplated that both colour and monochrome imaging methods may provide useful information about the condition of the cards. Similarly both digital and analogue sensing methods are seen to have independent utility and functionality with regard to both suit and value detection as well as the detection of faults, wear and tampering. It should be noted that the compartmentalisation of the card transport path into distinct lighting and sensing zones may be applied to any one of the embodiments disclosed within this document and suggested in the accompanying FIGS. 1–14.

As shown in FIG. 16, each playing card may be cleaned as it enters the transport path 500 by positioning a rotating brush 501 so that it impinges on, in this example, the drive roller 510. The drive roller transfers dirt etc. from the cards to the brush 501. As best seen in FIG. 18, this brush is generally cylindrical and preferably includes radially oriented camel hair bristles. Camel hair bristles resist the effect of moisture and are capable of removing grease, talc and dirt from the cards.

FIG. 16 also illustrates that the card accumulation area 503 may take the form of an elevator. The elevator is driven by a motor such as a DC stepping motor which is coordinated with the action of the drive and transport rollers. The elevator is adapted to removably receive a container 504. The container 504 may be in the form of a security box which temporarily and mechanically interconnects with the elevator mechanism. The elevator and therefore the box 504 begin at an upper 505 position and gradually descend as more cards are placed on top of the accumulating output stack 506. The elevator movement ensures that cards entering the box 504 do not flip over and become "boxed". When the box 504 is full or when the inspection operation is complete, the box 504 is removed. Prior to closing or sealing the box with its lid (not shown), the printed report which is output by the device's printer is inserted in the box 504. The box may be sealed for security while it is stored or being moved from one location to another. The box 504 or at least its cover may be transparent to enable the report to be viewed without breaking the security seal.

The cleaning brush 501 may be driven by or synchronized with a synchronisation belt 511 which is also connected to the drive roller 510.

As shown in FIGS. 16 and 19, the device may also be provided with an integral handle 520 for convenience of handling. In some embodiments, the back of the cover 521 may be hinged at a lower extremity 522 so that the transport path may be conveniently accessed if required for the purpose of maintenance or the clearing of the transport path 500.

While the invention has been described with reference to particular details of construction, these should be taken as illustrative and useful in various combination and not as limitations to the scope or spirit of the invention.

What is claimed is:

1. A method for automatically checking the integrity of a pack of cards prior to play, which includes the steps of:

a) assessing for a particular card game the desired number and suit of cards and the maker of the cards;

b) passing cards from a deck individually past a digital camera;

c) illuminating the playing face of the cards with only a blue light source and collecting images in said camera from the card face, containing the suit and value of the card;

d) matching the images for each card against stored templates for cards by the same card manufacturer and for each card identifying the value and suit of the card or detecting it as unrecognized;

e) counting each card as its image is matched;

f) deducing if all cards are present, identifying any missing cards and if any superfluous cards are present; and g) preparing a status report based on the deductions of step f).

2. A method as claimed in claim 1, wherein the back of each card is also checked for anomalies.

3. A method as claimed in claim 1, in which said transport mechanism transports cards individually into a security container which can be sealed.

4. A method as claimed in claim 3, in which the status report is also included in the sealed container.

5. The method set forth in claim 1, wherein a grey value threshold is employed to classify pixels as black and white.

6. The method set forth in claim 1, wherein objects are classified in black and white, and when a significant number of small objects are detected, the card is treated as being reversed.

7. The method set forth in claim 1, wherein an object corresponding to the suit of the card is identified by locating the largest object that does not touch a card border.

8. The method set forth in claim 1 together with the step passing a deck of cards past the digital camera and storing corner images as the templates.

9. The method set forth in claim 1 wherein the step of matching the images for each card against stored templates is accomplished by counting the number of pixels that differ in the match, and in the event that the difference is significant there is no match.

10. A playing card integrity checking machine which includes:

a hopper for one or more decks of cards;

a card inspection station located adjacent said hopper;

a card transport mechanism for removing individual cards from said hopper and transporting the cards individually past the inspection station to an exit or to an accumulator bin;

said card inspection station including only a blue light source to illuminate the card face containing the suit and value of the card, and a light receiver for receiving light reflected from said corner of said card;

a programmable device programmed to a) analyze the received image to determine the suit and value of individual cards;

b) match the images for each card against stored templates for cards by the same card manufacturer and for each card identifying the value and suit of the card or detecting it as unrecognized;

c) counting each card as its image is matched;

d) deducing, prior to play, if all cards are present, identifying any missing cards and if any superfluous cards are present;

display or printing means being connectable to said programmable device for displaying or printing a report of the deductions.

11. An integrity checker as claimed in claim 10, wherein the back of each card is also checked for anomalies.

12. An integrity checker as claimed in claim 10, in which said transport mechanism transports cards individually into a security container which is able to be sealed.

13. An integrity checker as claimed in claim 12 in which the security bin is supported within an elevator mechanism which lowers the bin as cards accumulate therein.

* * * * *